United States Patent [19]

Yanagida

[11] Patent Number: 4,556,926

[45] Date of Patent: Dec. 3, 1985

[54] ELECTROMAGNET DRIVING CIRCUIT

[75] Inventor: Shoji Yanagida, Yokohama, Japan

[73] Assignee: Ricoh Company, Ltd., Tokyo, Japan

[21] Appl. No.: 536,205

[22] Filed: Sep. 27, 1983

[30] Foreign Application Priority Data

Sep. 27, 1982 [JP] Japan ..... 57-168110
Oct. 30, 1982 [JP] Japan ..... 57-189982

[51] Int. Cl.[4] ..... H01H 47/32
[52] U.S. Cl. ..... 361/154; 361/152
[58] Field of Search ..... 361/152, 153, 154

[56] References Cited

U.S. PATENT DOCUMENTS 4,048,665 9/1977 Lia et al. ..... 361/152
4,347,544 8/1982 Ohba ..... 361/154

*Primary Examiner*—Reinhard J. Eisenzopf
*Attorney, Agent, or Firm*—Guy W. Shoup

[57] ABSTRACT

An electromagnet driving circuit particularly suited for use in impact printers as a means for driving to move a printing hammer includes a current control circuit for controlling a driving current to be applied to an electromagnet. In one aspect of the invention, a feed back circuit is provided between a voltage source and the current control circuit so as to compensate for fluctuations at the voltage source. In another aspect of the invention, the current control circuit is structured to use a temperature-dependent reference voltage in determining the level of the driving current thereby allowing to carry out a temperature-compensated operation.

7 Claims, 9 Drawing Figures

ELECTROMAGNET DRIVING CIRCUIT

BACKGROUND OF THE INVENTION

1. Field of the Invention

This invention relates to electromagnet driving circuits, and, in particular, to a driving circuit for controlling energization of an electromagnet for use in various machines such as impact printers, wire-dot printers, relay devices and buzzers. More specifically, the present invention relates to an electromagnet driving circuit for use in an impact printer for controlling energization of a driving coil which causes a printing hammer having an armature to move to apply an impact force on a selected type.

2. Description of the Prior Art

Electromagnets are well known in the art and used in various machines such as printers, relays, vibrators and buzzers. In particular, in impact printers such as a wheel printer which uses a print wheel, often referred to as "daisy wheel", an electromagnet forms an essential part as a means for driving to move a printing hammer. Since an electromagnet consists of a core and a coil wound around the core, when it is applied to impact printers, its core part is formed as a part of a printing hammer in the form of an armature and its coil is provided stationarily, whereby the coil is intermittently energized to cause the printing hammer to advance to hit a selected type carried by a print wheel. Thus, an electromagnet driving circuit is typically a circuit for controlling energization of a coil of electromagnet. When such an electromagnet driving circuit is desired to be controlled at high accuracy, it is commonly so structured to be driven by a constant current.

FIG. 1 illustrates a typical constant current type electromagnet driving circuit which has been used conventionally. As shown, it includes a coil MAG forming a part of an electromagnet to be driven, whose one end is connected to a voltage source V and whose the other end is connected to a collector of an NPN transistor $Q_3$, which, in turn, has its emitter connected to ground through a resistor $R_9$ or a capacitor $C_1$ and its base connected to a collector of a PNP transistor $Q_2$ through a resistor $R_8$. A protective diode $D_2$ is connected between the ends of the coil MAG. The emitter of transistor $Q_3$ is also connected to a non-inverting input terminal of an operational amplifier OP through a resistor $R_6$, and this non-inverting input terminal is also connected to another voltage source $V_Z$ through a resistor $R_3$. The op amp OP has its inverting input terminal connected to receive a reference voltage $V_r$ which is generated by a voltage divider consisting of resistors $R_1$ and $R_2$ which are connected between the voltage source $V_Z$ and ground in series. The op amp OP has its output connected to its non-inverting input terminal through a feed-back resistor $R_4$ and to the base of transistor $Q_2$ through a resistor $R_5$. Transistor $Q_2$ has its emitter connected to an emitter of transistor $Q_1$ which has its collector connected to a 5 V voltage source and its base connected to an input terminal to which a driving (control) pulse DRV is applied. Diodes $D_1$ and $D_3$ and resistors $R_7$ and $R_{10}$ are additionally provided as connected as shown.

In FIG. 1, $i_M$ indicates a driving current which passes through the coil MAG and $V_a$ indicates an input voltage to the non-inverting input terminal of op amp OP with $V_0$ indicating an output voltage of op amp OP.

The driving current $i_M$ passing through the coil MAG is detected as a voltage drop across the resistor $R_9$ having a relatively small resistance value, and the voltage at the junction between the resistor $R_9$ and the emitter of transistor $Q_3$ is supplied to the non-inverting input terminal of the op amp OP through the resistor $R_6$. On the other hand, the reference voltage $V_r$ determined by a ratio in resistance value between the two resistors $R_1$ and $R_2$ and the voltage level of the voltage source $V_Z$ is applied to the inverting input terminal of op amp OP, so that the op amp OP compares these two input voltages and controls the ON/OFF condition of transistor $Q_2$ according to the result of such comparison. The ON/OFF condition of transistor $Q_2$ thus controlled by an output of op amp OP is transmitted to the transistor $Q_3$ as valid information only when the transistor $Q_1$ is turned ON by receiving the driving pulse DRV. In this manner, the driving current $i_M$ is maintained at a predetermined level as a constant driving current.

FIG. 2 shows a relation between the driving pulse DRV and the driving current $i_M$ in the circuit of FIG. 1. In FIG. 2, $I_M$ indicates a predetermined level of a desired constant current and t indicates time.

The constant current level $I_M$ is related to the reference voltage $V_r$ with the following equation in the circuit of FIG. 1.

$$I_M = \left( \frac{V_0}{R_4} + \frac{V_r}{R_6} - \frac{V_Z - V_r}{R_3} \right) \times \frac{R_6}{R_9} \tag{1}$$

where, $V_r = V_a$.

Moreover, from the voltage waveform shown in FIG. 2, an energy W supplied to the coil MAG by the driving current $i_M$ may be expressed as follows:

$$W = K\left\{ \int_0^{t_1} \frac{V - V_{CE}}{R_M + R_9}\left(1 - e^{\frac{-t}{\tau 1}}\right) dt + \int_{t_1}^{t_2} I_M\, dt + \int_{t_2}^{t_3} I_M e^{\frac{-t}{\tau 1}}\, dt \right\} \tag{2}$$

$$t_1 = -\tau_1 l_n\left\{ 1 - \frac{I_M (R_M + R_9)}{V - V_{CE}} \right\} \tag{3}$$

where, $V_{CE}$: collector-emitter voltage of transistor $Q_3$ $R_M$: internal resistance of electromagnet MAG $\tau_1$: time constant for current rise $\tau_2$: time constant for current fall due to fly back voltage.

As is obvious from the above equations (1)–(3), when the voltage source V fluctuates, the current rise time $t_1$ shifts to $t_1'$ or to $t_1''$ as shown, which, in turn, will cause the energy W to change accordingly. Stated more in detail in this respect, when the source voltage V changes, the current rising characteristic changes as indicated by the dotted lines in accordance with changes in the voltage source V. That is, when the voltage source V increases, $t_1$ shifts to $t_1'$; on the other hand, when V decreases, $t_1$ shifts to $t_1''$. Under the condition, if the pulse width of driving pulse DRV ($t=0-t_2$), which determines a time period of passing current through the coil MAG, is maintained at constant, an integral value of $i_M$ from $t=0$ to $t=t_3$ will vary depending upon the rising characteristics of the driving current $i_M$. Thus, the energy W supplied to the coil MAG will differ according to the equation (2). As set forth above, even if the driving current $i_M$ is maintained at constant, the energy W given to the coil MAG will differ when the voltage source V connected to the coil MAG fluctuates. For this reason, if the coil MAG or its electromagnet as a whole requires to be driven by a constant energy, the driving circuit of FIG. 1 is inappropriate.

As described above, in some applications, it is rather important to drive an electromagnet or its coil with a constant energy rather than driving current in order to attain desired objectives. For example, in the case of impact printers, it is often required that a printing hammer be driven at constant energy so as to form imprints of uniform density. In such a case, the constant current type electromagnet driving circuit as described above is not sufficient. Therefore, there has been a need to develop a novel electromagnet driving circuit whose driving energy may be maintained at constant.

SUMMARY OF THE INVENTION

The disadvantages of the prior art are obviated by the present invention and an improved electromagnet driving circuit is hereby provided.

Therefore, a primary object of the present invention is to provide an improved electromagnet driving circuit.

Another object of the present invention is to provide an electromagnet driving circuit which is not adversely affected by fluctuations in voltage levels of a voltage source connected to one end of a driving coil of electromagnet.

A further object of the present invention is to provide an electromagnet driving circuit which is capable of driving an electromagnet with a constant driving energy.

A still further object of the present invention is to provide an electromagnet driving circuit which is not adversely affected by environmental temperature changes.

A still further object of the present invention is to provide an electromagnet driving circuit which is suitable for use in impact printers for controlling the movement of printing hammer.

Other objects, advantages and novel features of the present invention will become apparent from the following detailed description of the invention when considered in conjunction with the accompanying drawings.

DESCRIPTION OF THE PREFERRED EMBODIMENTS

Figure 3:
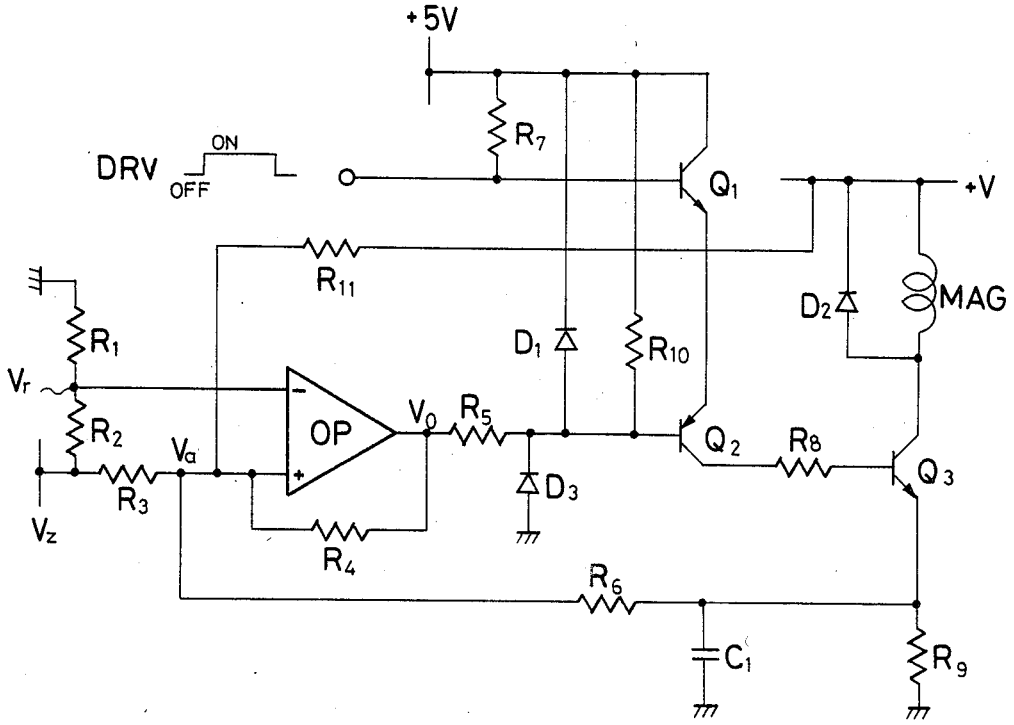
FIG. 3 is a circuit diagram showing the constant energy type electromagnet driving circuit which is not adversely affected by fluctuations at voltage source as constructed in accordance with one embodiment of the present invention.

Referring now to FIG. 3, there is shown an electromagnet driving circuit constructed in accordance with one embodiment of the present invention. Once compared with FIG. 1, it will be easily understood that the circuit of FIG. 3 is structurally similar to the circuit of FIG. 3 excepting that a resistor $R_{11}$ is provided as connected between the voltage source V and the non-inverting input terminal of the op amp OP. It is to be noted that those elements having the same reference numerals as in FIG. 1 indicate the same elements, and, thus, the previous description for those elements is also applicable to the circuit of FIG. 3. In the circuit of FIG. 3, a feed back circuit comprised of resistor $R_{11}$ is provided so that the voltage of voltage source V is supplied to the non-inverting input terminal of op amp OP through the feed back resistor $R_{11}$. As a result, the level of constant current $I_M$ is automatically varied in accordance with the voltage level at the voltage source V.

Figure 4:
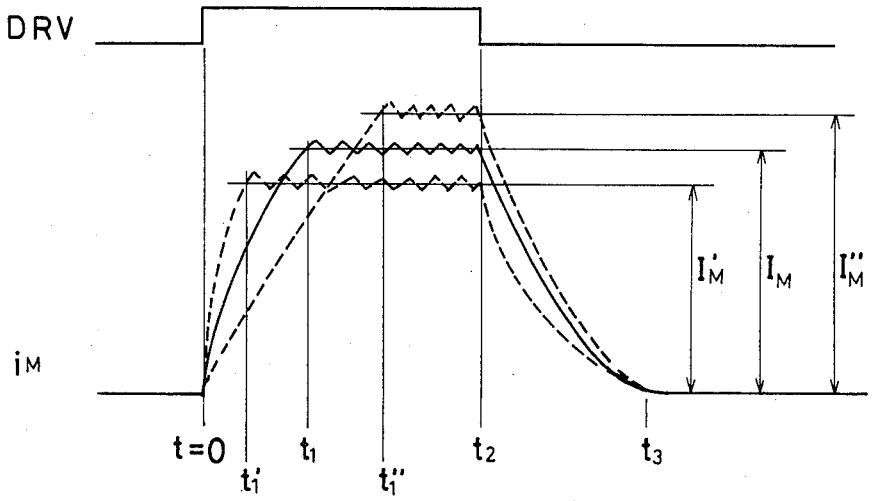
FIG. 4 is a timing chart which is useful for explaining the operation of the circuit of FIG. 3.

As shown in FIG. 4, in order to maintain the energy supplied to the coil MAG for a predetermined time period at constant, it is only necessary to maintain an integral value of $i_M$ over a time period from $t=0$ to $t=t_3$ even if the rising characteristic of $i_M$ changes due to fluctuations at the voltage source V. In the circuit of FIG. 3, the constant current $I_M$ as controlled by the op amp OP may be expressed as follows:

$$I_M = \left( \frac{V_0}{R_4} + \frac{V_r}{R_6} - \frac{V_Z - V_r}{R_3} - \frac{V}{R_{11}} \right) \times \frac{R_6}{R_9} \quad (4)$$

From the above equation (4), a fluctuating component $\Delta I_M$ of constant current $I_M$ when the voltage at the voltage source V fluctuates by an amount $\Delta V$ may be expressed as follows:

$$\Delta I_M = -\frac{R_6}{R_{11} \times R_9} \times \Delta V \quad (5)$$

As is obvious from the above equation (5), when the voltage source V increases, the constant current $I_M$ decreases; whereas, when the voltage source V decreases, the constant current $I_M$ increases. As explained with reference to equation (2) previously, the rising time $t_1$ of driving current $i_M$ varies depending upon the voltage level of voltage source V, which, in turn, causes the amount of energy W to fluctuate. Under the condition, in order to maintain the amount of energy to be supplied to the coil MAG at constant, it is only necessary to vary the level of constant current $I_M$ so as to compensate the fluctuating components of W due to fluctuations at the voltage source V. As an example, the feed back resistor $R_{11}$ having an appropriate resistance value may be provided as connected between the voltage source V and the non-inverting input terminal of the op amp OP as shown in FIG. 3. With the provision of the feed back resistor $R_{11}$, the level of constant current $I_M$ may be suitably changed to $I_M'$ or $I_M''$ as shown in FIG. 4.

FIG. 4 illustrates main components of a wheel printer to which the present invention may be applied advantageously in order to maintain the amount of energy to be applied to its printing hammer at constant. As shown, a wheel printer includes a printing hammer 1 which is to be driven to move by means of an electromagnetic driving mechanism and a print wheel 2 which is rotatably supported. In such a wheel printer, the printing hammer typically carries a core portion of an electromagnet or an armature and it is slidably supported so as to be able to move back and forth along its longitudinal direction. The solenoid portion of the electromagnetic driving mechanism is fixedly mounted on a main frame so as to generally enclose the armature of the printing hammer. Thus, the printing hammer may be driven to move forward when the solenoid is energized against the force of a compression spring which normally applies a biasing force in the backward direction. On the other hand, the print wheel 2 is generally comprised of a hub, a plurality of spokes extending radially from the hub and a plurality of types 2A each provided at the free ends of the spokes. The print wheel 2 is rotated to locate a selected type at a predetermined printing position. With the selected type located at the printing position, the hammer 1 is driven to advance forward electromagnetically as described before.

Figure 5:
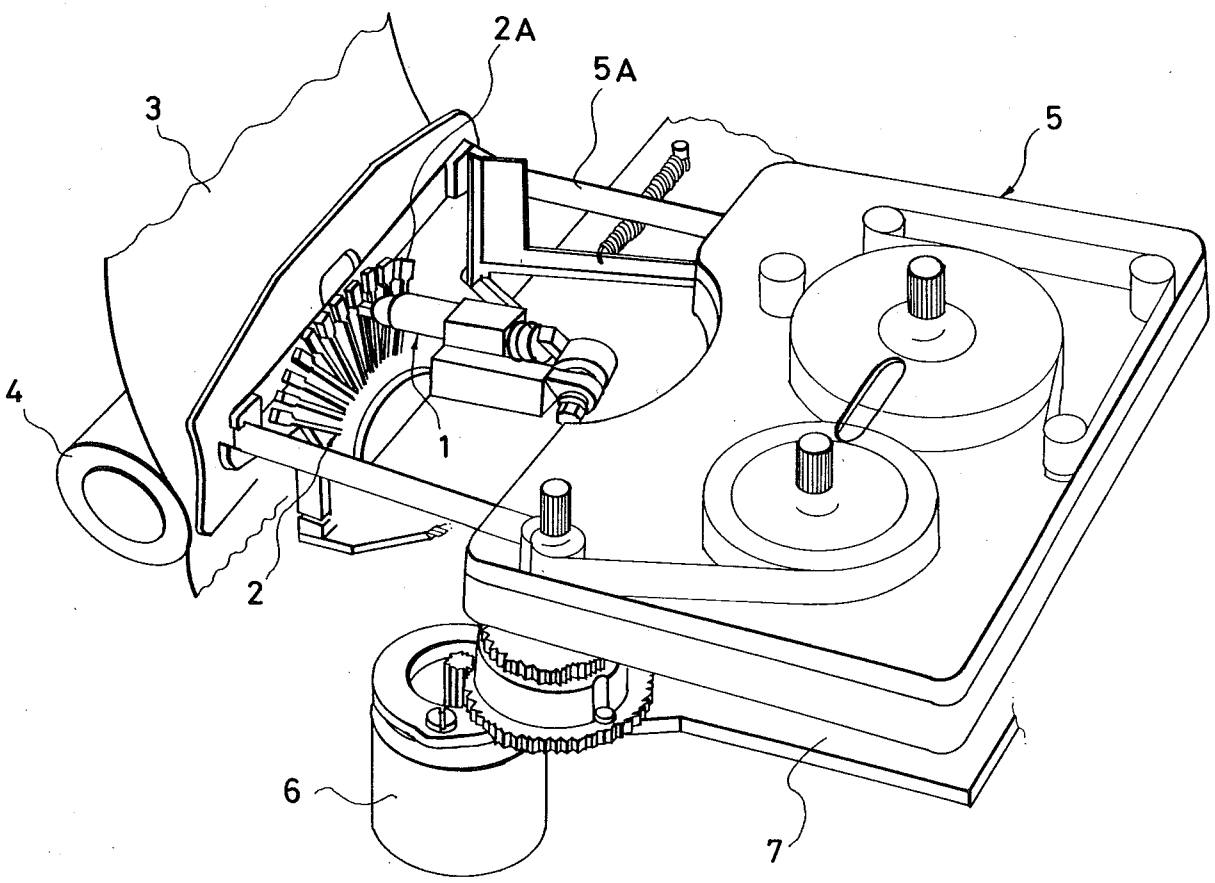
FIG. 5 is a schematic, perspective view showing main components of a typical wheel printer to which the present invention may be advantageously applied.

As shown in FIG. 5, recording paper 3 is placed around a platen roller 4 and an ink ribbon cassette 5 containing a supply spool and a take-up spool between which an ink ribbon 5A extends is disposed adjacent to the back of the hammer 1. Also shown in FIG. 5 is a feed motor 6 fixedly mounted on a support plate 7, which is operatively associated to a feed roller for causing the ink ribbon 5A to advance as printing proceeds. As may have been already understood, when the printing hammer 1 advances as electromagnetically driven by the driving mechanism, the printing hammer 1 presses the type of print wheel 2 located at the printing position against the platen roller 4 so that an imprint of the type is formed on the recording paper 3. In this instance, as described previously, the density of an imprint thus formed depends upon the amount of energy supplied to an electromagnetic driving mechanism which drives the printing hammer 1. Thus, in order to form imprints of uniform density, the amount of energy supplied to the driving mechanism, or the driving coil of electromagnetic driving mechanism needs to be controlled.

It is often the case with designing a voltage source for driving such an electromagnetic driving mechanism that voltage fluctuations of ±5–10% are taken into account as expected. And, thus, the presence of voltage fluctuations will be faithfully reflected in resulting imprints, which are thus poor in quality. On the other hand, if the electromagnet driving circuit of the present invention is applied, since it is possible to maintain the amount of energy to be supplied at constant even if there occur fluctuations in the voltage source, resulting imprints are insured to be of the same density. Thus, the present invention allows to obtain imprints of high quality at all times.

It should be noted that although the above description was made as to the case when the present invention has been applied to wheel printers, the present invention may be applied to various other machines and devices such as wire-dot printers, relays and buzzers, as desired.

Now, another aspect of the present invention for maintaining the amount of energy to be supplied to an electromagnet at constant irrespective of changes in the ambient temperature will be described. In general, when the ambient temperature of an electromagnet increases, the coil of electromagnet increases its electrical resistance, and, thus, its time constant $\tau = L/R$ (L: inductance of coil, R: electrical resistance of coil) becomes smaller and its ultimate current $I = V/R$ (V: voltage to be applied to the coil) also becomes smaller; however, as a net result, the current rising time becomes larger and thus the amount of energy becomes reduced. Furthermore, in the case of impact printers in which printing hammers are slidingly moved to form imprints, the frictional force acting on the sliding hammer varies depending upon the ambient temperature because frictional coefficients may vary as a function of temperature. It has been observed that the slidable printing hammer requires an increased amount of energy so as to produce imprints of equal density as the ambient temperature increases.

Figure 1:
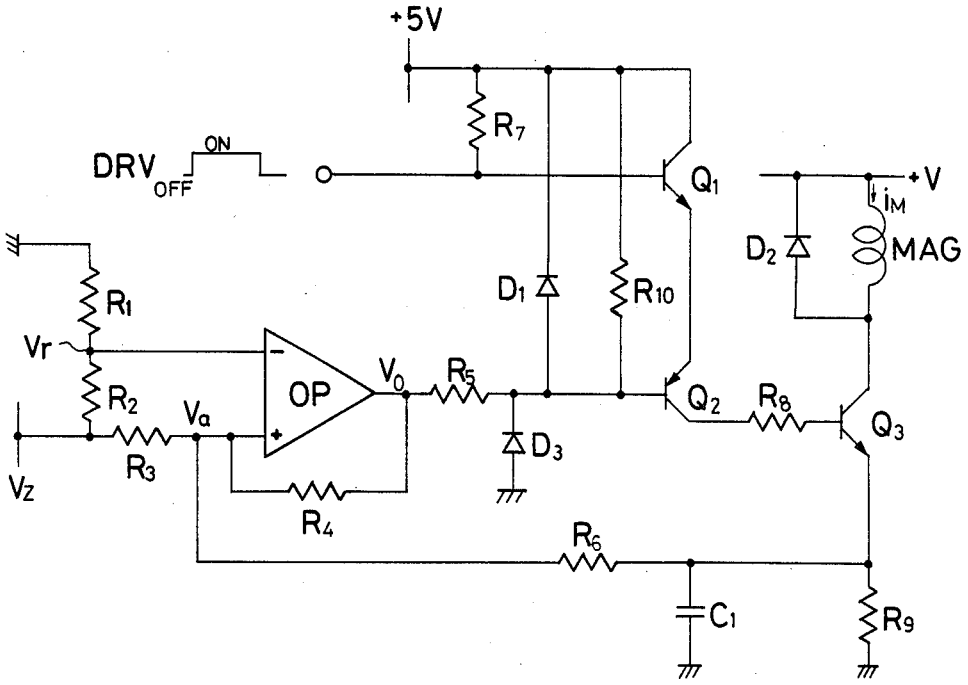
FIG 1 PRIOR ART
FIG. 1 is a circuit diagram showing a constant current type electromagnet driving circuit which has been used conventionally.
Figure 2:
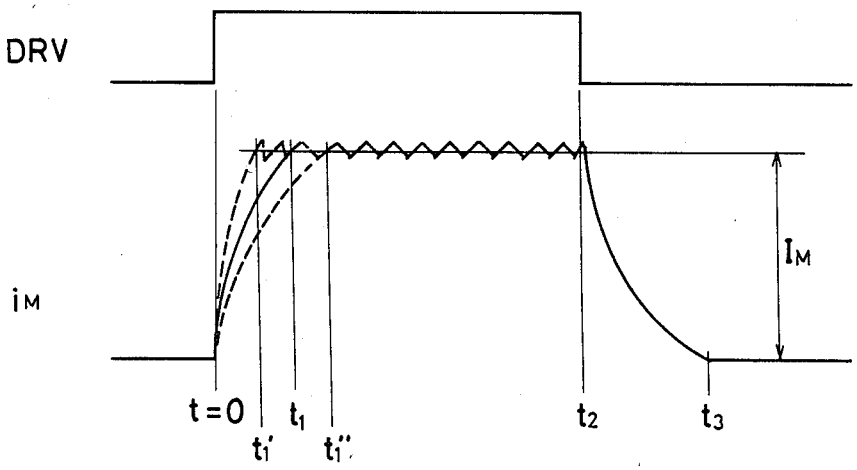
FIG 2 PRIOR ART
FIG. 2 is a timing chart which is useful for explaining the operation of the circuit of FIG. 1.
Figure 6:
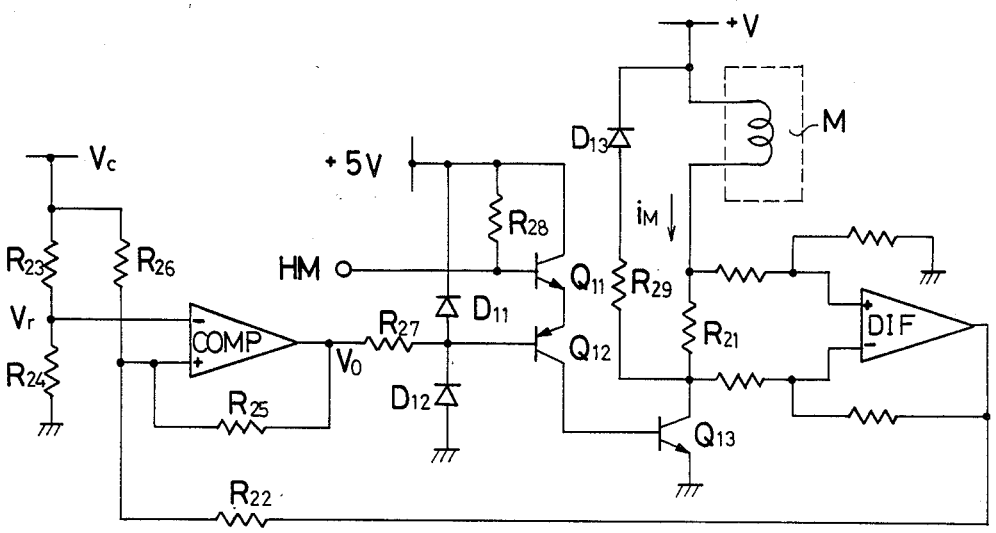
FIG 6 PRIOR ART
FIG. 6 is a circuit diagram showing another prior art constant current type electromagnet driving circuit.

FIG. 6 shows another prior art electromagnet driving circuit which is structurally similar to the circuit of FIG. 1. That is, the transistors $Q_{11}$, $Q_{12}$ and $Q_{13}$ of FIG. 6 correspond to the transistors $Q_1$, $Q_2$ and $Q_3$ of FIG. 1, respectively, and the resistors $R_{23}$, $R_{24}$, $R_{25}$, $R_{26}$, $R_{27}$ and $R_{28}$ of FIG. 6 correspond to the resistors $R_1$, $R_2$, $R_4$, $R_3$, $R_5$ and $R_7$ of FIG. 1, respectively. The diodes $D_{11}$, $D_{12}$ and $D_{13}$ of FIG. 6 correspond to the diodes $D_1$, $D_2$ and $D_3$ of FIG. 1, respectively. Instead of resistor $R_9$ in FIG. 1, a resistor $R_{21}$ is provided as connected between an electromagnet or its coil M and the collector of transistor $Q_{13}$. Another resistor $R_{21}$ is provided as connected between the anode of diode $D_{13}$ and the collector of transistor $Q_{13}$. Corresponding to the resistor $R_6$ of FIG. 1, a resistor $R_{22}$ is provided as connected between the non-inverting input terminal of a comparator COMP, which is basically an operational amplifier, and an output terminal of a differential amplifier DIF whose two input terminals are connected to both ends of the resistor $R_{21}$ through respective resistors. The voltage source $V_Z$ of FIG. 1 corresponds to a voltage source $V_c$ of FIG. 6. Finally, the driving pulse DRV of FIG. 1 is indicated as a driving pulse HM in FIGS. 6 and 7.

Figure 7:
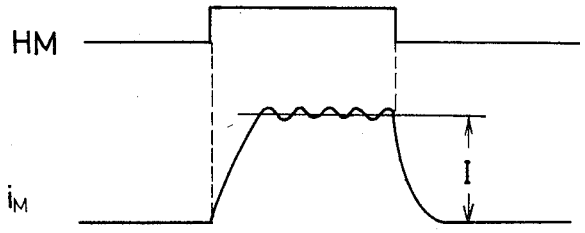
FIG 7 PRIOR ART
FIG. 7 is a timing chart which is useful for explaining the operation of the circuit of FIG. 6.

Similarly with the circuit of FIG. 1, the comparator COMP receives the reference voltage $V_r$ at its one input terminal and an output from the differential amplifier DIF through the resistor $R_{22}$ at its the other input terminal, and the comparator COMP compares these two inputs. When the reference voltage $V_r$ is larger, an output from the comparator COMP causes the transistors $Q_{12}$ and $Q_{13}$ to be turned on thereby allowing the driving current $i_M$ to flow through the coil M; whereas, when the reference voltage $V_r$ is smaller, the transistors $Q_{12}$ and $Q_{13}$ are turned off by an output from the comparator COMP thereby preventing the driving current $i_M$ from flowing through the coil M. In this manner, the driving current $i_M$ flowing through the coil M is regulated at constant level I as shown in FIG. 7. Similarly with the previous case, this constant current I may be expressed as in the following manner.

$$I = \frac{R_{22}}{R_{21}\beta}\left\{ V_c k\left(\frac{1}{R_{23}} + \frac{1}{R_{25}} + \frac{1}{R_{22}}\right) + \frac{V_0}{R_{25}} - \frac{V_c}{R_{23}} \right\} \quad (6)$$

where, $\beta$: amplification factor of amplifier DIF k: $R_{24}/(R_{23}+R_{24})$ $V_0$: output voltage $V_0$ of comparator COMP.

When the electromagnet M is used as a means for driving a printing hammer of an impact printer, as shown in FIG. 5, a driving system for moving the printing hammer has an overall temperature coefficient including the temperature coefficient of electromagnet driving circuit and the temperature coefficient of a structure for supporting the printing hammer in a slidably movable manner. In such an impact printer, it has been found empirically that the temperature coefficient of the structure which supports the printing hammer slidably movably plays a predominant role in many cases. Thus, by knowing such a temperature coefficient before-hand, the driving current $i_M$ may be varied accordingly in order to maintain the amount of energy, or printing energy, to be supplied to the printing hammer at constant.

Denoting a conversion factor from current to printing energy by $K_e$, the relation between driving current $i_M$ and energy $W_p$ produced by the electromagnet M may be expressed as follows:

$$W_p = K_e \int i_M dt \quad (7)$$

Thus, it is only required to vary the driving current $i_M$ so as to compensate the following fluctuating component of printing energy.

$$\Delta W_p = K_e \int \Delta i_M dt \quad (8)$$

As a result, if the value of k in the equation (6) is varied depending upon temperature to vary the level of constant current I to be supplied to the coil M, the above-described fluctuating component of printing energy may be compensated. Therefore, in accordance with another aspect of the present invention, by using a resistor having a temperature coefficient which satisfies the above equation (8) as the resistor $R_{23}$ or $R_{24}$ in the circuit of FIG. 6, the level of constant current I to be supplied to the coil M may be made variable with respect to ambient temperature, thereby allowing to compensate the fluctuating component of equation (8) and to maintain printing energy (impact energy transferred to the type 2A from the hammer 1 in FIG. 5) at constant.

Supposing that the fluctuating component $\Delta I$ of constant current I with respect to temperature is generally proportional to $\int \Delta i_M dt$, then we have the following relation.

$$\Delta I = K \int \Delta i_M dt \quad (9)$$

where, K: constant.

From the above equations (7) and (8), the following equation may be obtained.

$$W_p = -\frac{K_e}{K}\Delta I \quad (10)$$

Accordingly, it is only necessary to set the temperature coefficient of k, and, thus, resistor $R_{23}$ or $R_{24}$ such that the temperature coefficients of $W_p$ and I are identical but opposite in sign. In other words, denoting the temperature coefficient of $W_p$ by $a_1$ and that of k by $a_2$, the temperature coefficient of resistor $R_{23}$ or $R_{24}$ should be appropriately selected so as to satisfy the following relation.

$$a_1 = \frac{-\left(V_c k a_2\left(\frac{1}{R_{23}} + \frac{1}{R_{25}} + \frac{1}{R_{22}}\right) + \frac{V_0}{R_{25}} - \frac{V_c}{R_{23}}\right)\frac{R_{22}}{R_{21}\beta}}{I} \quad (11)$$

Figure 8:
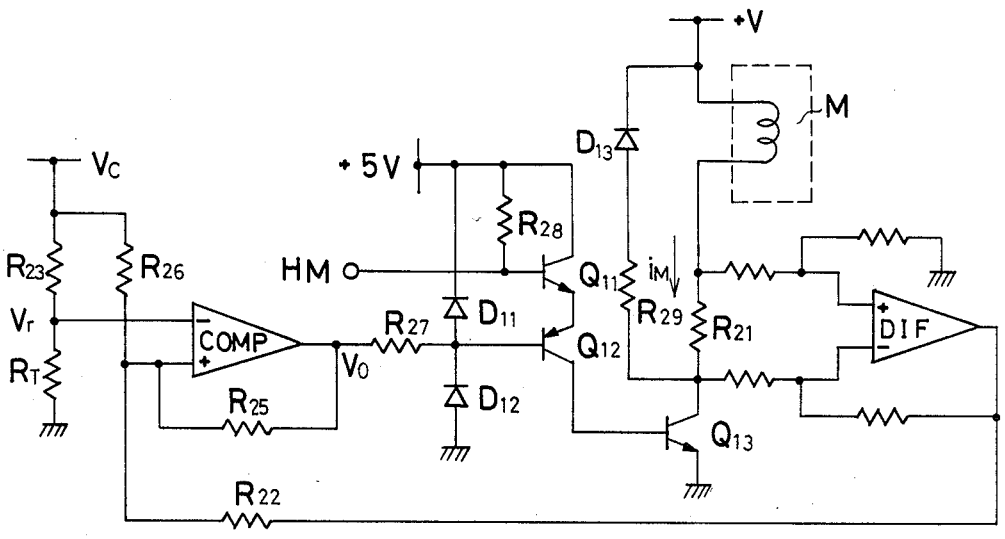
FIGS. 8 and 9 are circuit diagrams showing two embodiments of the present invention, which are not adversely affected by temperature changes in the environment.
Figure 9:
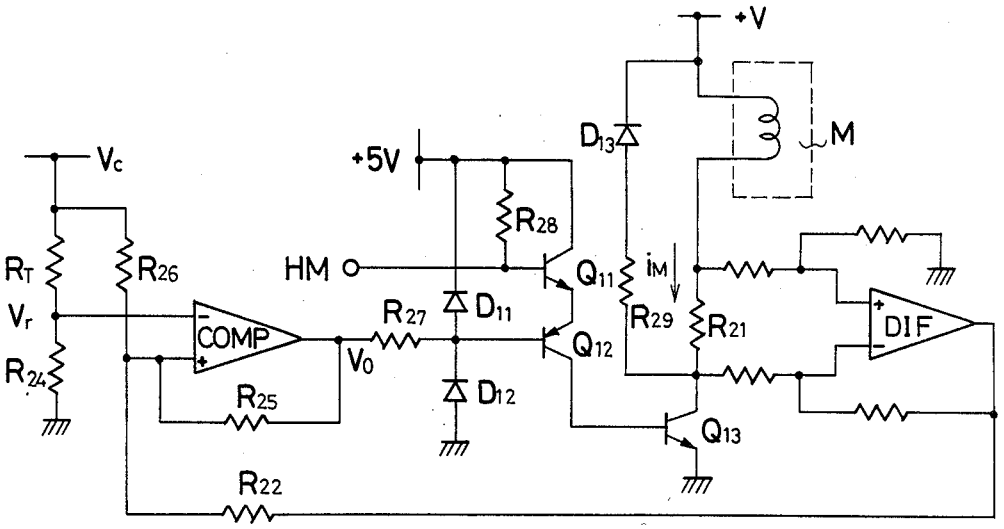

FIGS. 8 and 9 illustrate two embodiments constructed in accordance with the above-described aspect of the present invention. In the circuit of FIG. 8, the resistor $R_{24}$ of FIG. 6 is substituted by a resistor $R_T$ having a temperature coefficient as described above; whereas, in the circuit of FIG. 9, the resistor $R_{23}$ of FIG. 6 is substituted by another resistor $R_T$ having an appropriate temperature coefficient. The overall circuit structure of either of FIGS. 8 and 9 is similar to that of FIG. 6. It is to be noted that the resistor $R_T$ has a temperature coefficient which is larger than that of resistor $R_{23}$ or $R_{24}$ by the factor of approximately 10–20. When the resistor $R_T$ has such a larger temperature coefficient as compared with that of resistor $R_{23}$ or $R_{24}$, the temperature coefficient of $R_{23}$ or $R_{24}$ may be neglected.

FIG. 8 illustrates the temperature-compensated electromagnet driving circuit constructed in accordance with the present invention, and this circuit is so structured to compensate fluctuating components of printing energy when the printing energy has a negative temperature coefficient. Thus, the temperature-dependent resistor $R_T$ in this embodiment has a positive temperature coefficient. As a result, as temperature rises, the electrical resistance value of $R_T$ increases and the level of reference voltage $V_{ref}$ increases thereby increasing the level of constant current I. In other words, in this embodiment, a reduction of printing energy due to an increase in temperature because the resistor $R_T$ has a negative temperature coefficient is compensated by an increase in the level of constant current I.

FIG. 9 illustrates the temperature-compensated electromagnet driving circuit which is similar to that of FIG. 8 but has a temperature-dependent resistor $R_T$ in place of the resistor $R_{23}$ in FIG. 6. Thus, the circuit of FIG. 9 is to be used for the case in which printing energy fluctuates with positive temperature coefficient. In this embodiment, as temperature increases, the level of constant temperature I decreases.

Alternatively, use may be made of a resistor $R_T$ having a negative temperature coefficient. In this case, the temperature-dependent resistor $R_T$ should be replaced with either resistor $R_{23}$ or $R_{24}$ oppositely as from the above description.

While the above provides a full and complete disclosure of the preferred embodiments of the present invention, various modifications, alternate constructions and equivalents may be employed without departing from the true spirit and scope of the invention. Therefore, the above description and illustration should not be construed as limiting the scope of the invention, which is defined by the appended claims.

What is claimed is:

1. An electromagnet driving circuit comprising:

a voltage source;

an electromagnet having a pair of first and second ends, said first end being electrically connected to said voltage source;

current control means provided as connected between said second end of said electromagnet and a first reference voltage for controlling a driving current passing through said electromagnet, said current control means including a first input terminal which is connected to detect the level of said driving current; and feed back means connected between said voltage source and said first input terminal for transmitting fluctuating components of said voltage source to said first input of said current control means thereby allowing to compensate for fluctuation components of said voltage source.

2. A circuit of claim 1 wherein said first reference voltage is ground.

3. A circuit of claim 2 wherein said electromagnet includes a coil having two ends which correspond to said first and second ends of said electromagnet.

4. A circuit of claim 3 wherein said current control means includes a first switching means and a first resistor which are connected in series between said second end and said first reference voltage, and said current control means further includes a comparing means having said first input terminal, a second input terminal for receiving a second reference voltage and an output terminal connected to supply its output to said first switching means whereby said first switching means is operated according to said output from said comparing means.

5. A circuit of claim 4 wherein said current control means further includes a second switching means interposed between said comparing means and said first switching means and a third switching means connected between said second switching means and a third reference voltage, said third switching means is connected to receive a control signal which regulates a time period of current control operation.

6. A circuit of claim 5 wherein said first, second and third switching means each include a transistor switch.

7. A circuit of claim 6 wherein said feed back means includes a resistor having a predetermined electrical resistance value.

* * * * *